US006199237B1

(12) United States Patent
Budden

(10) Patent No.: US 6,199,237 B1
(45) Date of Patent: Mar. 13, 2001

(54) UNDERWATER VACUUM

(76) Inventor: Brent Budden, LiquiVision Technology Inc., P.O. Box 5277, Klamath Falls, OR (US) 97601

( * ) Notice: Subject to any disclaimer, the term of this patent is extended or adjusted under 35 U.S.C. 154(b) by 0 days.

(21) Appl. No.: 09/189,860

(22) Filed: Nov. 12, 1998

(51) Int. Cl.[7] ..... E04H 4/16
(52) U.S. Cl. ..... 15/1.7
(58) Field of Search ..... 15/1.7

(56) References Cited

U.S. PATENT DOCUMENTS 3,795,027 * 3/1974 Lindberg, Jr. .
4,084,535 * 4/1978 Rees ..... 15/1.7
4,498,206 * 2/1985 Braukmann .
5,044,034 * 9/1991 Iannucci ..... 15/1.7
5,404,607 * 4/1995 Sebor .
5,412,826 * 5/1995 Raubenheimer .
5,617,600 * 4/1997 Frattini .

FOREIGN PATENT DOCUMENTS

468876 * 1/1992 (EP) .
1092133 * 11/1967 (GB) .

* cited by examiner

*Primary Examiner*—Randall E. Chin
(74) *Attorney, Agent, or Firm*—Richard C. Litman

(57) ABSTRACT

An underwater vacuum including a housing having an opening which is positioned adjacent the surface to be cleaned. The housing also supports a rotatable brush powered by a turbine energized by water flow through the vacuum. The housing has a water outlet which communicates with a pump at the surface of the water. The inlet to the turbine has a trap which collects large debris that could damage the turbine blades. The vacuum has two rear wheels that are adjustably attached to the interior of the housing, and two front wheels that are adjustably attached to the exterior of the housing. The underwater vacuum can remove sediment from a water storage reservoir without causing turbidity in the water column. A second handheld embodiment is used for cleaning sloping berms, and has rear wheels that are also powered by the turbine.

20 Claims, 7 Drawing Sheets

UNDERWATER VACUUM

BACKGROUND OF THE INVENTION

1. Field of the Invention

The present invention relates to an underwater vacuum. More particularly, the invention relates to an underwater vacuum specifically designed for removing bacterial film from large drinking water reservoirs.

2. Background and Description of the Related Art

Protection of the public's health requires that potable water supplies be free of microorganisms that can cause health effects in humans. Also, supplies of potable water must be free from other contaminants that may taint the water and/or negatively impact its acceptability by the consumer, i.e. the members of the public. To ensure consistent and acceptable water quality, rules and regulations regarding testing, maintenance, and maximum tolerable levels of contaminants for potable water reservoirs have been established. Disinfectant chemicals are used to destroy microorganisms in the water. However, it has been shown that sediment which characteristically accumulates at the bottom of potable water reservoirs insulates biological contaminants from the disinfection chemicals. Inspection of water storage tanks is recommended at least every five years. Many municipalities, which are charged with ensuring the quality of the water, opt to clean and inspect their reservoirs every year.

This annual cleaning and inspection has traditionally been done by first draining the reservoir and then having teams of men physically enter the reservoir to clean and inspect it. This approach has many drawbacks, and some examples of these drawbacks are listed below. First, the procedure is wasteful of natural resources and is very costly. Second, the draining and filling of the reservoir can disturb the sediment, releasing biological contaminants into the pipes in the water distribution area served by that reservoir. Third, draining and filling a reservoir causes mechanical stress to the structure of the reservoir, which can lead to cracks in the reservoir structure. Fourth, the men entering the reservoir with their tools can cause damage to the protective finish on the walls of the reservoir. Fifth, when a reservoir is drained there will usually not be an adequate supply of water to fight a major fire in the water distribution area served by the reservoir.

To avoid the aforementioned drawbacks, the underwater vacuum system of the present invention has been proposed. The underwater vacuum of the present is particularly adapted to ensure that the vacuum can remove sediment from the reservoir without causing turbidity in the water and thus avoiding the attendant introduction of biological contaminants into the water. The underwater vacuum of the present invention allows a team of divers to accomplish the cleaning of a potable water reservoir without the drawbacks associated with the periodic emptying and filling of the reservoir.

Although many underwater vacuum systems have been proposed in the art, none are seen to be specially adapted for the removal of sediment from potable water reservoirs while keeping any turbidity or biological contamination introduced into the water within the exacting requirements for potable water reservoirs.

The following patents and other documents illustrate some examples of underwater vacuums that have been proposed in the underwater vacuum art.

U.S. Pat. No. 3,795,027, issued to Albert W. Lindberg, Jr. on Mar. 5, 1974, and U.S. Pat. No. 4,498,206, issued to Heinz W. Braukmann on Feb. 12, 1985, show underwater vacuums having fixed brush bristles for cleaning swimming pools.

U.S. Pat. No. 5,404,607, issued to Pavel Sebor on Apr. 11, 1995, shows a self-propelled underwater vacuum for cleaning swimming pools. The Sebor device uses one or more pivotally mounted oscillators, that are caused to oscillate by the flow of water through the vacuum, to cause the vacuum to move in a random path along the bottom of the swimming pool.

U.S. Pat. No. 5,412,826, issued to Dennis A. Raubenheimer on May 9, 1995, shows a self-propelled underwater vacuum for cleaning swimming pools. The Raubenheimer device uses a turbine driven by the flow of water through the suction cleaner to power a pair of wheels that propel the vacuum.

U.S. Pat. No. 5,617,600, issued to Ercole Frattini on Apr. 8, 1997, shows a self-propelled underwater vacuum for cleaning swimming pools. The Frattini device uses a submersible electric motor to drive a pump impeller to create suction and to drive a set of rollers to propel the underwater vacuum.

United Kingdom Complete Patent Specification Number 1,092,133, By Russell Edward Winn, published on Nov. 22, 1967, shows an underwater vacuum for cleaning the hulls of ships or inside storage tanks. The Winn device is a self propelled vacuum with a steerable wheel and a pump for creating suction. The Winn device also has two rotating brushes that rotate about axes perpendicular to the surface being cleaned. The Winn device is not concerned with the introduction of contaminants into the surrounding water column.

European Patent Application Number 468,876, By Michael John Chandler et al., published on Jan. 29, 1992, shows a self-propelled underwater vacuum which uses a turbine to power the drive wheels of the vacuum. The device of chandler et al. has fixed brush bristles.

None of the above inventions and patents, taken either singularly or in combination, is seen to describe the instant invention as claimed. In particular, none of the above inventions and patents disclose a turbine powered brush having an axis of rotation parallel to the surface being cleaned and/or the unique structure of the suction head of the present invention which allows vacuuming sediment without introducing turbidity, and the attendant biological contaminants, into potable water supplies.

SUMMARY OF THE INVENTION

The present invention is directed to an underwater or submersible vacuum including a housing having an opening which, in use, is positioned adjacent the surface to be cleaned. The housing also supports a rotatable brush and a turbine. The housing has a water outlet which communicates with a pump at the surface of the water. Water flowing through the vacuum is routed through the turbine. The inlet to the turbine has a trap which collects large debris that can damage the turbine blades. The flow of water through the turbine powers the rotation of the brush. The brush bristles project beyond the plane of the opening so as to contact the surface being cleaned.

The vacuum has four wheels that support the vacuum adjacent the surface being cleaned while allowing free movement of the underwater vacuum over the surface. The two rear wheels are adjustably attached to the interior of the housing, while the two front wheels are adjustably attached to the exterior of the housing. The particular arrangement and attachment of the wheels contributes to the capability of the underwater vacuum of the present invention to remove sediment from the bottom of a water storage reservoir without causing turbidity in the water column.

A second handheld embodiment has rear wheels that are powered by the turbine powering the brush. The handheld embodiment is used for cleaning sloping berms in concrete water reservoirs.

Accordingly, it is a principal object of the invention to provide an underwater vacuum that can remove sediment from the bottom of a water storage reservoir without causing turbidity in the water column.

It is another object of the invention to provide an underwater vacuum having a brush that can loosen sediment on the bottom of a water storage reservoir prior to the removal of the sediment by the suction of the vacuum.

It is a further object of the invention to provide an underwater vacuum having a turbine in the path of water flow through the vacuum such that the turbine can power the rotation of a brush used to loosen sediment on the bottom of a water storage reservoir.

Still another object of the invention is to provide an underwater vacuum having wheels that are specially configured to support the vacuum above the surface to be cleaned such that the vacuum opening is supported at the right height and at the right angle above the surface to be cleaned so as to allow the surface to be cleaned without the generation of turbidity in the water column.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
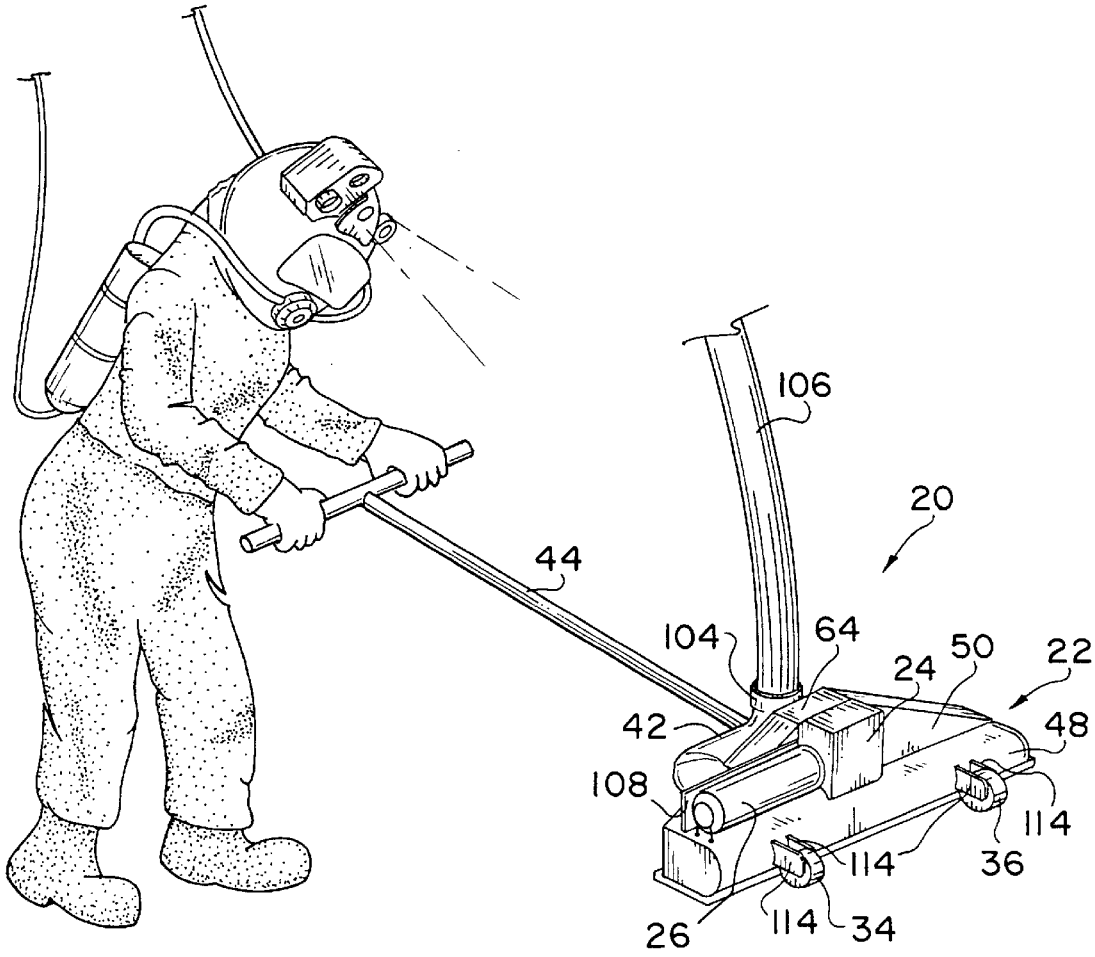
FIG. 1 is an environmental view of an underwater vacuum according to the present invention being used by a diver.
Figure 2:
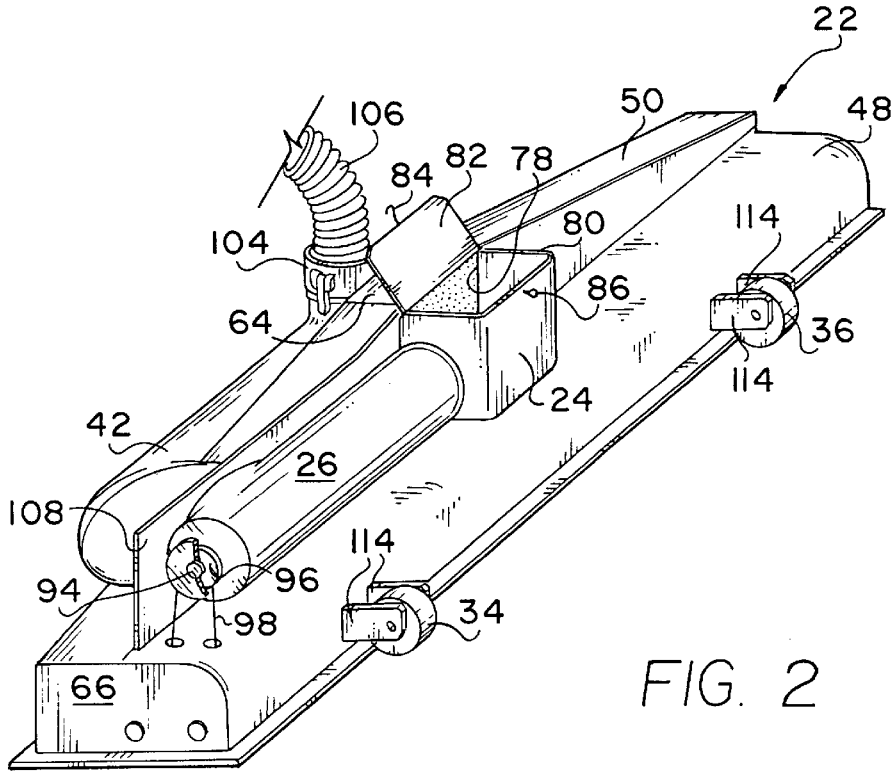
FIG. 2 is a perspective view of an underwater vacuum according to the present invention.

Referring to FIGS. 1–7, the present invention is an underwater vacuum 20 which includes a housing 22, a debris trap 24, a cylindrical turbine housing 26, turbines 28 and 30, a rotating brush 32, front wheels 34 and 36, rear wheels 38 and 40, an outlet pipe 42, and a T-shaped handle 44. The housing 22 has a suction opening 46, a base portion 48, and a cap portion 50. The suction opening 46 is substantially rectangular. By substantially rectangular it is intended to convey that the opening 46 is generally rectangular and the perimeter may deviate from a perfect rectangle in that the opening 46 may have rounded corners or fillets at corners, or the opening 46 may have clearance channels (shown in FIG. 7) for the mounting hardware of the shaft of the rotating brush 32. The substantially rectangular perimeter of the suction opening 46 defines the plane of the suction opening. The suction opening 46 has a rear edge 52, a front edge 54, a left edge 56, and a right edge 58.

The cap portion 50 has a rear wall 60 and a front wall 62 which is spaced apart from the rear wall 60. The cross sectional area, in a plane parallel to the plane of the suction opening 46, of the cap portion 50 tapers from a maximum where the cap portion 50 joins the base portion 48 to a minimum at the cap portion top 64. The front wall of the base portion 48 is curved or rounded and it extends from the suction opening front edge 54 to the front wall 62 of the cap portion 50. The front wall of the base portion 48, or a portion thereof, follows or parallels the contour of a cylindrical surface defined by the tips of the bristles of the brush 32. The rear wall of the base portion 48 extends, perpendicular to the plane of the suction opening 46, from the suction opening rear edge 52 to the rear wall 60 of the cap portion 50. The base portion 48 has a right sidewall 66 and a left sidewall 68.

The right sidewall 66 is joined to the rear wall of the base portion 48 along substantially the entire length of the right edge of the rear wall of the base portion 48. The top edge of the right sidewall 66 is joined to the cap portion 50 along substantially the entire length of the right edge of the widest portion of the cap portion 50. The right sidewall 66 is joined to the front wall of the base portion 48 along substantially the entire length of the curved right edge of the front wall of the base portion 48. The bottom edge of the right sidewall 66 essentially forms the right edge 58 of the suction opening 46.

The left sidewall 68 is joined to the rear wall of the base portion 48 along substantially the entire length of the left edge of the rear wall of the base portion 48. The top edge of the left sidewall 68 is joined to the cap portion 50 along substantially the entire length of the left edge of the widest portion of the cap portion 50. The left sidewall 68 is joined to the front wall of the base portion 48 along substantially the entire length of the curved left edge of the front wall of the base portion 48. The bottom edge of the left sidewall 68 essentially forms the left edge 56 of the suction opening 46. The front and rear walls of the base portion 48, the left sidewall 68, the right sidewall 66, and the cap portion 50 cooperatively form an enclosure or concavity which opens to the suction opening 46.

The brush 32 is rotatably supported intermediate the left sidewall 68 and the right sidewall 66. The brush 32 is oriented such that it axis of rotation is parallel to the plane of the suction opening 46. The brush 32 has a central shaft 70 each end of which is journaled in mounting hardware attached to a respective one of the left and right sidewalls 68 and 66. The details of the mounting hardware will be discussed later. The bristles of the brush 32 may have their roots embedded directly in the shaft 70 or, alternatively, the roots of the sleeves may be embedded in a cylindrical sleeve 72 (see FIGS. 10 and 11) which is keyed or otherwise fixed to the shaft 70. Most preferably, the roots of the bristles of each half of the brush 32 are embedded over a helical strip into either the sleeve 72 or the shaft 70. The helical strips over which the bristles are embedded are angled in opposite directions for each half of the brush 32 such that the bristles on each half of the brush 32 act as screw conveyors moving the sediment toward the center of the suction opening 46 where it can be vacuumed up more readily and with a lesser chance of escaping to the outside of the housing 22.

Figure 3:
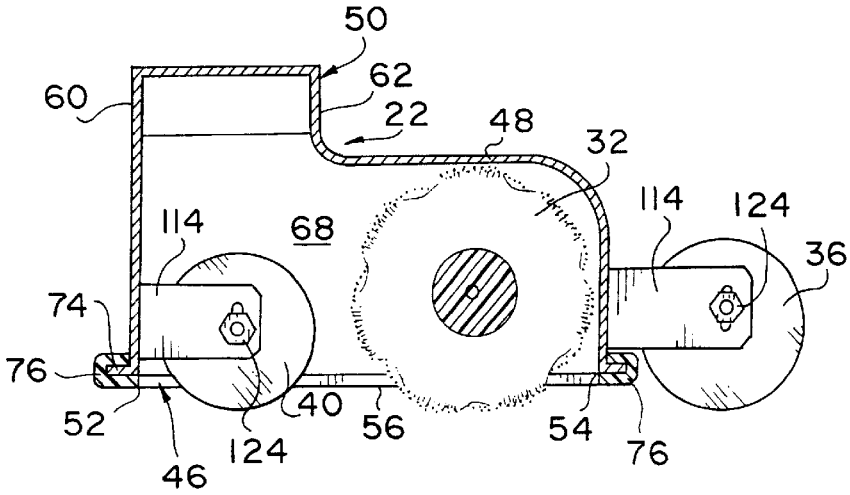
FIG. 3 is a section view of an underwater vacuum according to the present invention taken through the left side of the underwater vacuum.
Figure 4:
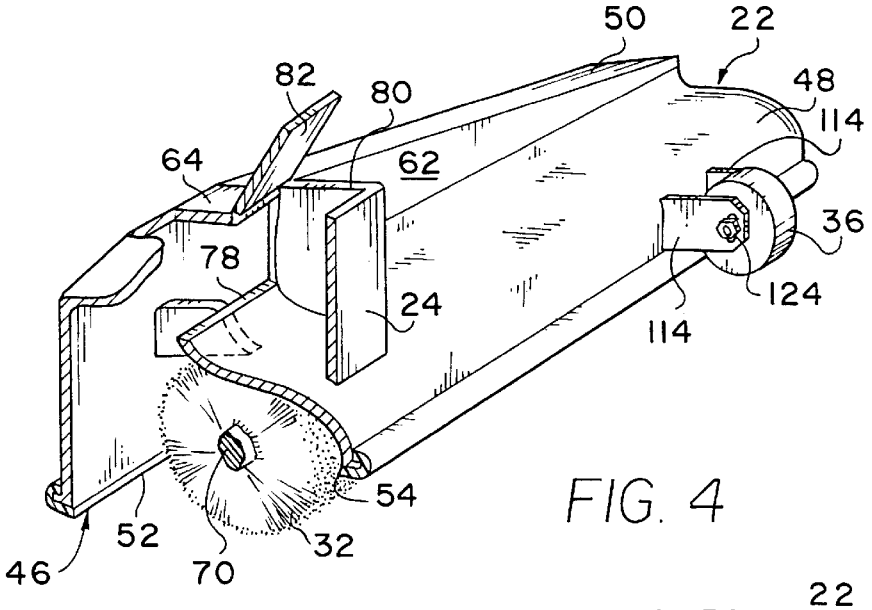
FIG. 4 is a cutaway perspective view showing the opening to the debris trap of an underwater vacuum according to the present invention.
Figure 5:
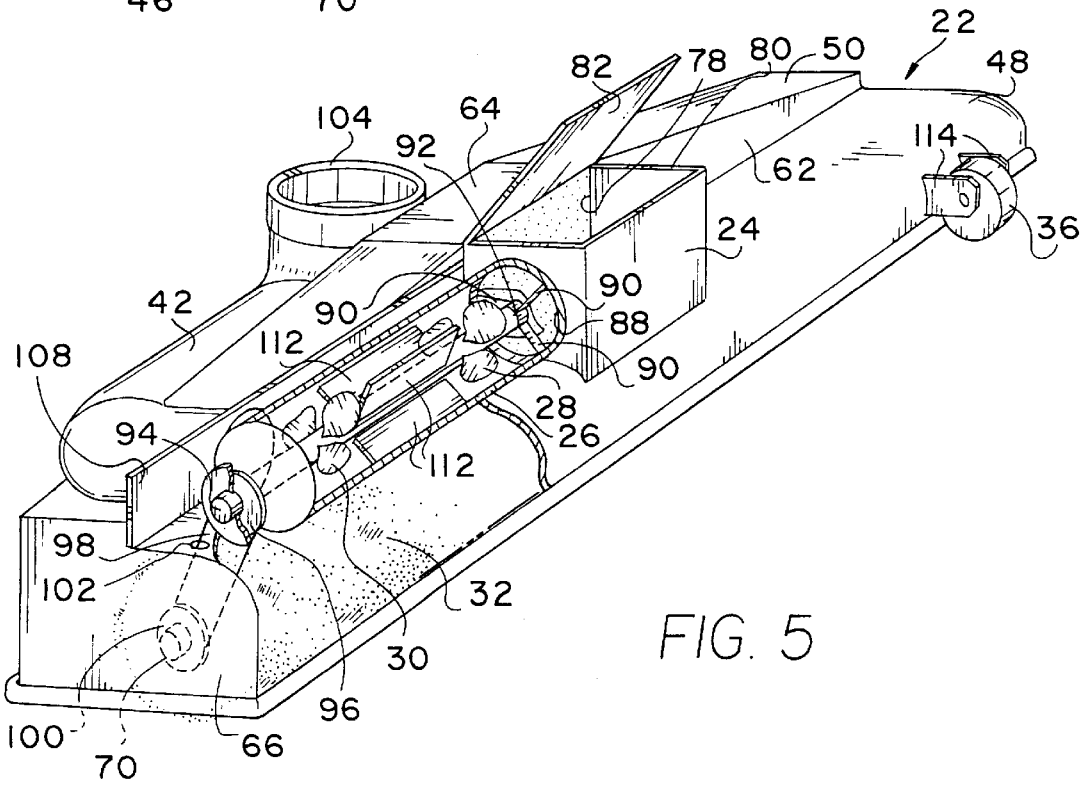
FIG. 5 is a cutaway perspective view showing the interior of the turbine and the drive linkage to the rotating brush of an underwater vacuum according to the present invention.
Figure 6:
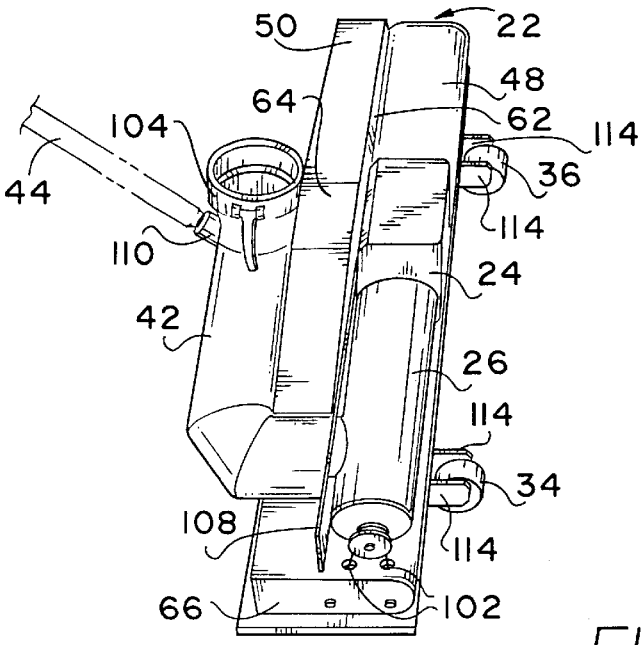
FIG. 6 is a top perspective view showing the water outlet of an underwater vacuum according to the present invention.
Figure 7:
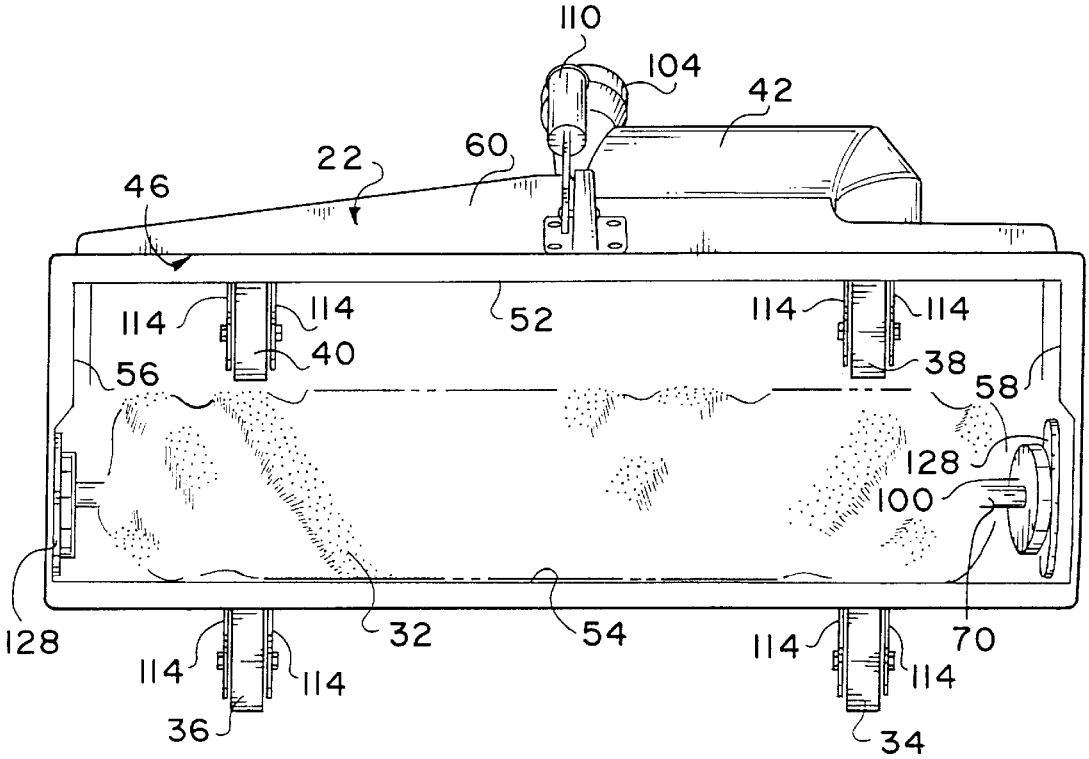
FIG. 7 is a bottom perspective view showing the positions of the brush and the wheels in relation to the suction opening of an underwater vacuum according to the present invention.
Figure 8:
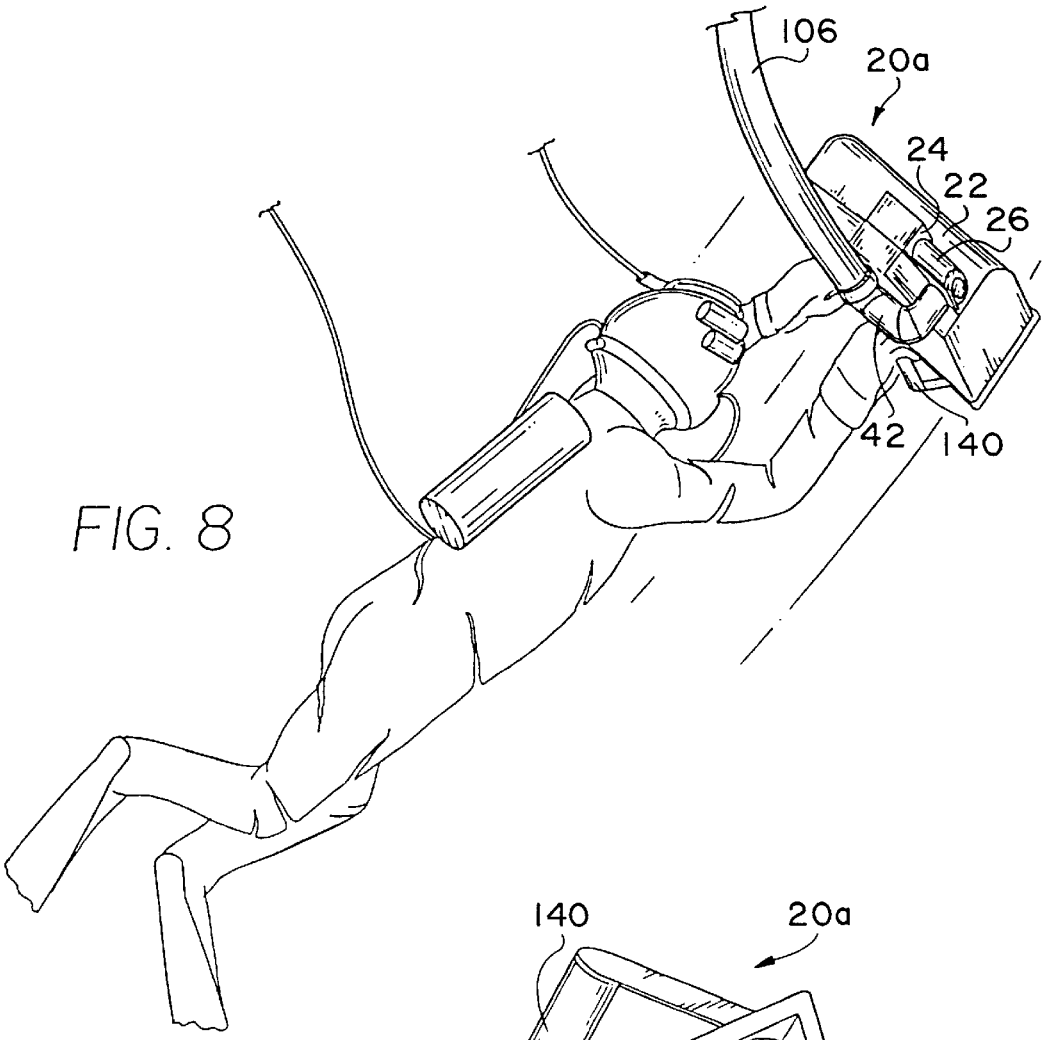
FIG. 8 is an environmental view of a handheld version of the underwater vacuum according to the present invention being used by a diver to clean a sloping berm.
Figure 9:
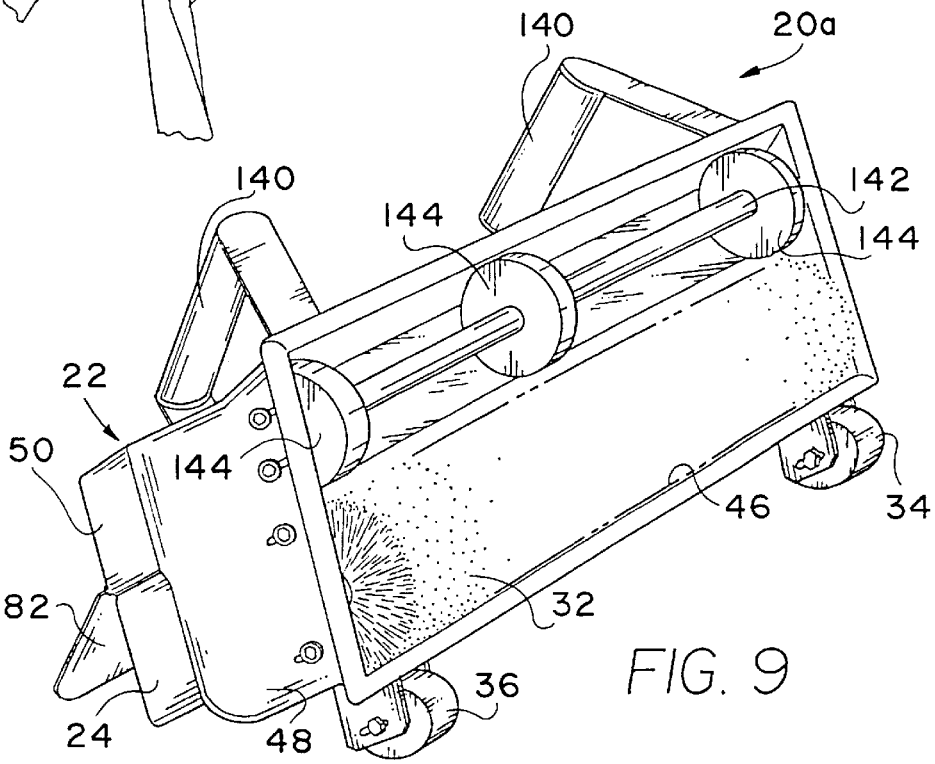
FIG. 9 is a bottom perspective view showing the positions of the brush and the wheels in relation to the suction opening of the handheld version of the underwater vacuum according to the present invention.

Referring to FIG. 3, the brush 32 is powered to rotate such that the bristles of the brush 32 move toward the rear of the housing 22 as the bristles pass under the axis of rotation of the brush 32. This means that with the underwater vacuum 20 oriented as illustrated in FIG. 3, the brush 32 is powered to rotate in the clockwise direction. For the helically arranged bristles to push sediment toward the center of the housing 22, the bristles on the right half of the brush 32 are arranged along a helical strip having an acute helix angle when measured from the inside surface of the right sidewall 66 in a clockwise direction. Also, the bristles on the left half of the brush 32 are arranged along a helical strip having an acute helix angle when measured from the inside surface of the left sidewall 68 in a counter clockwise direction, as illustrated in FIG. 7.

The brush 32 is positioned within the housing 22 such that the bristles of the brush project for a user determined distance beyond the plane of the suction opening 46. The brush 32 has soft bristles so as not to damage the surface coatings of the water reservoir being cleaned. In addition, a flange 74 projects from about the suction opening 46. The flange 74 is covered by a soft bumper 76 made of a rubber or plastic material. The bumper 76 provides further protection against damage to the surfaces of the reservoir being cleaned due to being bumped by the housing 22.

The front wheels 34 and 36 are attached to the outer surface of the frontmost portion of the front wall of the base portion 48 of the housing 22. The rear wheels 38 and 40 are attached to the inner surface of the rear wall of the base portion 48 of the housing 22, such that the rear wheels 38 and 40 are positioned intermediate the brush 32 and the rear wall of the base portion 48 of the housing 22. The wheels 34, 36, 38, and 40 are attached at their respective locations in such a way that they can all rotate freely. The wheels 34, 36, 38, and 40 support the housing 22 at a user selected height above the surface of the reservoir that is being cleaned, and these wheels allow the underwater vacuum 20 to be pushed along the surface being cleaned. The details of the attachment of the wheels 34, 36, 38, and 40 are discussed later.

An opening 78 is provided in the front wall 62 of the cap portion 50 of the housing 22. A reinforcing bar 77 extends between the front and rear walls of the base portion 48. The reinforcing bar 77 helps keep the rear wall, formed by the rear walls of the base portion 48 and the cap portion 50, of the housing 22 from collapsing under the pressure differential between the exterior and the interior of the housing 22. The opening 78 communicates with the debris trap 24. The debris trap 24 is formed by three walls, two of which project perpendicularly from the front wall 62 on either side of the opening 78. The third wall forming the debris trap 24 extends between the edges, located distal from the front wall 62, of the two walls which project from the front wall 62. The walls forming the debris trap 24 also join the top surface of the curved front wall of the base portion 48. Thus, the top surface of the curved front wall of the base portion 48 forms the bottom of the debris trap 24. The open top 80 of the debris trap 24 is provided with a hinged closure 82 which can be secured in the closed position by the latch 84.

In the illustrated example, the latch 84 is in the form of a hook that is engageable with an eye 86; however, the latch 84 may be of any known type. A sealing strip or gasket (not shown) may be provided about the perimeter of the closure 82 to provide a water tight seal about the open top 80 of the debris trap 24. To maximize water flow through the housing 22, an essential feature for eliminating turbidity, the opening 78 should be made as large as possible. Most preferably, the opening 78 has a width approximately equal to the distance between the interior surfaces of the right and left walls of the debris trap 24 and a height approximately equal to the distance between the top 64 of the cap portion 50 and the top edge of the front wall of the base portion 48.

The cylindrical turbine housing 26 is fixed to the right wall of the debris trap 24. The right wall of the debris trap 24 has a hole 88 with a diameter essentially equal to the inside diameter of the cylindrical turbine housing 26. The hole 88 allows fluid communication between the interior of the debris trap 24 and the interior of the turbine housing 26. Spokes 90 concentrically support a bearing 92 which rotatably supports an end of the turbine shaft 94. The turbine shaft 94 extends through the closed end of the turbine housing 26 such that the end of the shaft 94 distal from the bearing 92 lies outside the turbine housing 26. The portion of the shaft 94 passing through the closed end of the turbine housing 26 is journaled within a bearing surface formed in the closed end of the turbine housing 26, such that the shaft 94 can rotate freely.

Spokes 90, in addition to supporting the bearing 92, act as a screen to keep debris that may damage the blades of turbines 28 and 30 from entering the turbine housing 26. Where relatively smaller particles or debris cause concern relating to possible damage to the blades of the turbines 28 and 30, a wire mesh screen may be provided at the opening 88. Debris trapped in the debris trap 24 can be removed through the hinged closure 82.

A pulley 96 is fixedly attached to the end of the shaft 94 which is outside the turbine housing 26. A belt 98 frictionally engages the pulley 96 and a pulley 100 which is fixedly attached to the shaft 70. Thus, rotation of the turbine shaft 94 causes the rotation of the brush shaft 70. The belt 98 passes through holes 102 formed in the upper portion of the front wall of the base portion 48. The belt 98 is in the form of an endless loop.

Any suitable power transmission mechanism may be substituted for the belt 98 and the pulleys 96 and 100 without departing from the spirit and scope of the present invention.

For example, a chain and sprockets can be used in place of the belt 98 and the pulleys 96 and 100, or the shaft 70 can be extended to the exterior of the housing 22 and a fully enclosed gear train used transmit power from an extended shaft 94 to the shaft 70.

The turbines 28 and 30 are of the axial flow type and are positioned in tandem within the turbine housing 26. The blades of each of the turbines 28 and 30 are fixed to the common turbine shaft 94 such that the turbine blades and the shaft 94 rotate together. Thus, water flow past the blades of the turbines 28 and 30 powers the rotation of the shaft 94 and in turn, through the use of the belt 98, the rotation of the brush 32.

As water passes through the upstream turbine 28 and rotating current is generated in the water flowing through the turbine housing 26. This rotating current causes the downstream turbine 30 to lose effectiveness. To remedy this problem, re-directional baffles 112 are provided intermediate the turbines 28 and 30. The baffles 112 are fixed to the inside surface of the cylindrical wall of the turbine housing 26 and extend radially inward toward the shaft 94, but the baffles 112 do not touch the shaft 94 so as not to interfere with the rotation of the shaft 94. The baffles 112 straighten out the flow of the water, i.e. restore the flow to purely axial flow as much as possible, before the water impinges upon the blades of the downstream turbine 30 to thereby restore efficiency to the downstream turbine 30 and thus increase the combined power output from the turbines 28 and 30.

The outlet of the turbine housing 26 is positioned intermediate the downstream turbine 30 and the closed end of the turbine housing 26. The outlet of the turbine housing 26 communicates with the outlet pipe 42. The inlet of the outlet pipe 42 is rigidly fixed about the outlet of the turbine housing 26. The outlet pipe 42 extends directly rearward from the turbine housing 26 until the outlet pipe 42 clears the rear wall of the cap portion 50 of the vacuum housing 22. Once clear of the rear wall of the cap portion 50 of the vacuum housing 22, the outlet pipe 42 makes a first bend. The outlet pipe 42 extends, parallel to the plane of the suction opening 46, from the first bend toward the middle of the housing 22. Once near the middle portion of the housing 22, i.e. near the portion of the rear wall 60 extending downward from the top 64 of the cap portion 50, the outlet pipe 42 makes a second bend and extends upward perpendicular to the plane of the suction opening 46. The outlet pipe 42 terminates in a coupling 104 that allows the outlet pipe 104 to be connected to a hose 106 which is in turn connected to a pump (not shown) at the surface. A support plate 108 is rigidly fixed to the front wall 62 of the cap portion 50. The outlet pipe 42 passes through the support plate 108 near the joint between the turbine housing 26 and the outlet pipe 42. Thus the support plate 108 supports the inlet to the outlet pipe 42, and the support plate 108 also supports the closed end of the turbine housing 26 via the inlet to the outlet pipe 42.

A socket 110 is pivotally attached to the rear wall, formed by the rear walls of the base portion 48 and of the cap portion 50, of the housing 22. The socket 110 allows the attachment of the T-shaped handle 44. The angle of the socket 110 relative to the rear wall of the base portion 48 can be fixed at any desired angle by the user. The fixing of the socket angle can, for example, be accomplished frictionally by tightening a nut and bolt passing through the pivot point of the socket 110.

In use, the underwater vacuum 20 is placed on the bottom surface of a potable water reservoir such that it is supported over the bottom of the reservoir by the four wheels 34, 36, 38, and 40. When the vacuum 20 is thus positioned, the suction opening will be positioned adjacent the surface to be cleaned. The hose 106 connects the outlet pipe 42 to a pump located above the surface of the water in the reservoir. Such pumps are well known and are therefore not described here. A diver then stands behind the vacuum 20 and grasps the T-shaped handle 44. The pump is now turned on, causing water to be drawn through the suction opening 46, through the housing 22, and up the hose 106. The diver then walks behind the vacuum 20, pushing the vacuum 20 along the bottom of the reservoir, to apply the cleaning action of the vacuum 20 to an increasingly wider area of the reservoir bottom.

Due to the suction created by the pump, water rushes into the housing 22 through the suction opening 46. The water moves at a high flow rate up the cap portion 50 of the housing 22. The water then passes through the opening 78 and into the debris trap 24. From the debris trap 24 the water rushes through the turbine housing 26, through the outlet pipe 42, and up the hose 106 to the surface. As the water rushes through the turbine housing 26, the axial flow turbines 28 and 30 and the shaft 94 are caused to rotate or spin. The rotating shaft 94 causes the rotation of the shaft 70 via the pulleys 96 and 100 and the belt 98. The brush 32, being fixed to the shaft 70, is set in motion rotating about the longitudinal axis of the shaft 70. The rotating brush 32 scrubs the reservoir bottom dislodging the sediment film coating the reservoir bottom. The dislodged sediment and the biological contaminants contained in it are carried, by the water rushing through the housing 22, up the hose 106 and to the surface where the water containing the sediment is discarded in accordance with applicable regulations. This process continues as long as the pump is turned on. Thus, the removal of the sediment, also known as biofilm, from the bottom of the reservoir is effected without introducing turbidity into the reservoir water.

The positioning of the wheels 38 and 40 inside the housing 22 is also another essential feature for eliminating turbidity during the operation of the vacuum 20. Attaching the wheels 38 and 40 to inside surface of the rear wall of the base portion 48 places the axis of rotation of the wheels 38 and 40 ahead of the rear edge 52 of the suction opening 46. If the diver operating the vacuum 20 pushes down on the T-shaped handle 44, the vacuum 20 will pivot about the axis of rotation of the wheels 38 and 40 such that the rear edge 52 of the suction opening 46 contacts the bottom of the reservoir while water can continue to rush into the housing 22 around the side and front edges of the suction opening 46. With the vacuum 20 in this position, sediment dislodged by the brush 32 cannot escape through the rear of the housing 22. The small angle through which the housing 22 pivots when the handle 44 is pushed down is not sufficient to cause the brush 32 to lose contact with the reservoir bottom, given that the brush bristles in contact with the reservoir bottom are normally in a state of flexion. This feature is particularly important to preventing turbidity in the reservoir water when turning or maneuvering the vacuum 20 along a path that is not a straight line.

Figure 13:
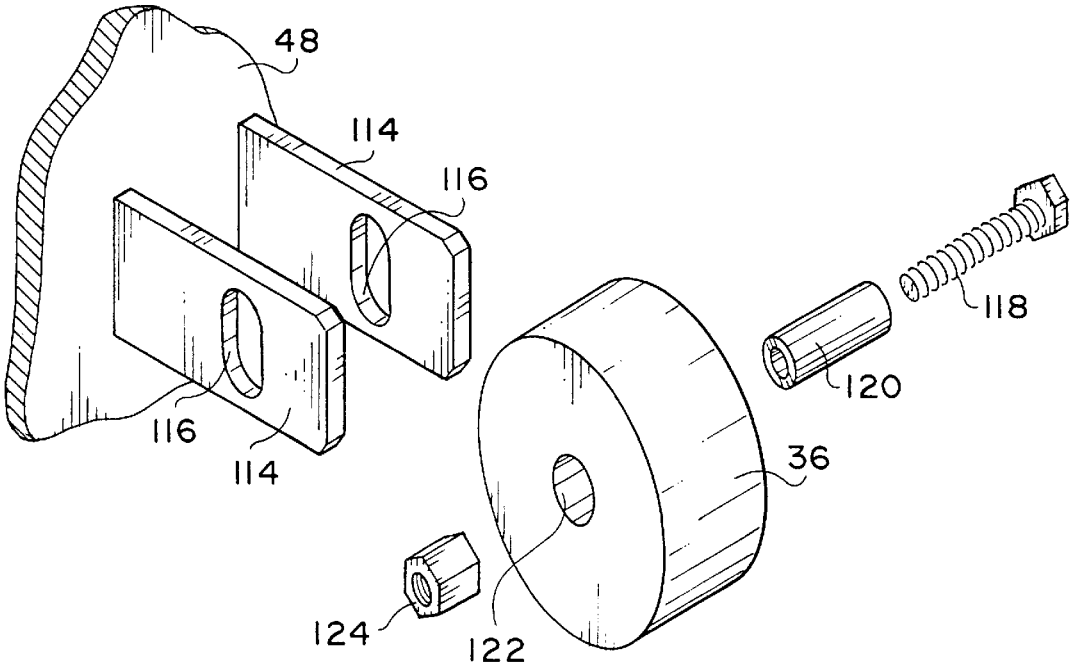
FIG. 13 is a fragmentary view showing the height adjustment mechanism for the wheels of the underwater vacuum according to the present invention.

Referring to FIG. 13, a height adjustable attachment for the wheels 34, 36, 38, and 40 can be seen. Wheel 36 is being used as representative of all the wheels 34, 36, 38, and 40. A pair of parallel plates 114 are fixedly attached to the housing 22. In the case of the wheels 34 and 36 the plates 114 would be attached to the front wall of the base portion 48, while in the case of the wheels 38 and 40 the plates 114 would be attached to the rear wall of the base portion 48.

Each plate 114 has an elongated slot 116. The slots 116 are in registry with one another. The slots 116 are just wide enough for the threaded shaft of the bolt 118 to pass through the slots 116. The length of the slots 116 provides the range of adjustment of the position of the wheel 36 in a direction perpendicular to the plane of the suction opening 46.

The wheel 36 is rotatably supported by the bushing 120 which is slightly longer than the wheel 36 is wide. The plates 114 are spaced apart to allow the bushing 120 to fit therebetween. When the bushing 120 is placed between the plates 114, the central bore of the bushing 120 can be brought into registry with the slots 116. The inside diameter of the bushing 120 is about the same as the width of the slots 116. The outside diameter of the bushing 120 is greater than the width of the slots 116. With the bushing 120 placed through the central hole 122 of the wheel 36, the bushing 120 is then placed between the plates 114 with the central bore of the bushing 120 in registry with the slots 116. The bolt 118 is then passed through the slots 116 and the bushing 120, and the nut 124 is threadedly engaged to the end, distal from the bolt head, of the bolt 118. The wheel 36 is then moved to the desired position along the slots 116 and the nut 124 is tightened to frictionally secure the wheel 36 in place while allowing free rotation of the wheel 36.

Figure 12:
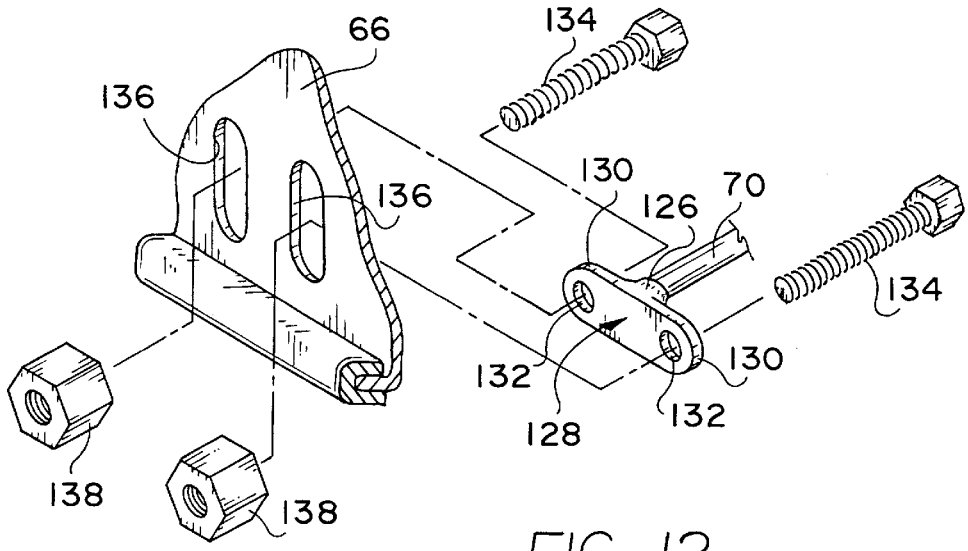
FIG. 12 is a fragmentary view showing the height adjustment mechanism for the brush of the underwater vacuum according to the present invention.

Referring to FIG. 12, a height adjustable attachment for the shaft 70 can be seen. Each end of the shaft 70 is journaled within the central boss or cylindrical portion 126 of the mounting attachments 128. The mounting attachments 128 have lateral extensions 130 which are provided with bolt holes 132. The bolt holes 132 are in registry with elongated slots 136. A pair of slots 132 is formed in each of the side walls 66 and 68 for the shaft 70. Only the attachment of the right end of the shaft 70 is shown in detail, the attachment of the left end of the shaft 70 being a mirror image of the right end. Each one of a pair of bolts 134 pass s through a respective bolt hole 132 and a respective slot 136. The slots 136 are just wide enough for the threaded shaft of the bolt 134 to pass through the slots 136. The length of the slots 136 provides the range of adjustment of the position of the shaft 70 in a direction perpendicular to the plane of the suction opening 46.

Each one of a pair of nuts 138 is threadedly engaged to the end, distal from the bolt head, of a respective one of the bolts 134. The ends of the shaft 70 are then moved to the desired position along the slots 136 and the nuts 138 are tightened to friction ally secure the shaft 70 in place. The belt 98 is elastic and is sized to remain under tension, and in frictional engagement with pulleys 96 and 100, over the entire adjustment range of the shaft 70. The adjustable attachments of the wheels 34, 36, 38, and 40 and of the shaft 70 allow the underwater vacuum to be adjusted for sediment accumulations having varying thicknesses.

Referring to FIGS. 8–11, a second handheld embodiment of the underwater vacuum made in accordance with the present invention can be seen. The handheld underwater vacuum 20*a* is designed for cleaning sloping berms that exist in some concrete potable water reservoirs. These berms are generally too steep for a diver to walk along without slipping. The vacuum 20*a* differs from the vacuum 20 in only two respects. First the vacuum 20*a* is self-propelled because the slope of the berm will not allow a diver adequate footing to push the vacuum 20*a* up the berm. Second the T-handle 44 and the socket 110 are replaced by a pair of handholds or grips 140 which are fixedly attached to the rear wall of the housing 22, the rear wall of the housing 22 being formed by the combination of the rear wall of the base portion 48 and the rear wall 60 of the cap portion 50. To make the vacuum 20*a* self-propelled several modifications are made to the design of the vacuum 20 as discussed below.

The rear wheels 38 and 40 and their attachments have been eliminated from the vacuum 20*a*. A shaft 142 is provided intermediate the brush 32 and the rear wall of the base portion 48 of the housing 22. The longitudinal axis of the shaft 142 is parallel to the longitudinal axis of the shaft 70. Each end of the shaft 142 is rotatably supported by a respective one of the sidewalls 66 and 68 using adjustable attachments exactly as shown in FIG. 12 and described above with reference to FIG. 12. The shaft 142 is mechanically linked to the shaft 70 and/or the shaft 94 such that the shaft 142 is powered to rotate by the turbines 28 and 30. Three wheels 144 are fixedly attached to the shaft 142 and rotate therewith. The middle wheel 144 is equidistant from the right and left wheels 144.

Figure 10:
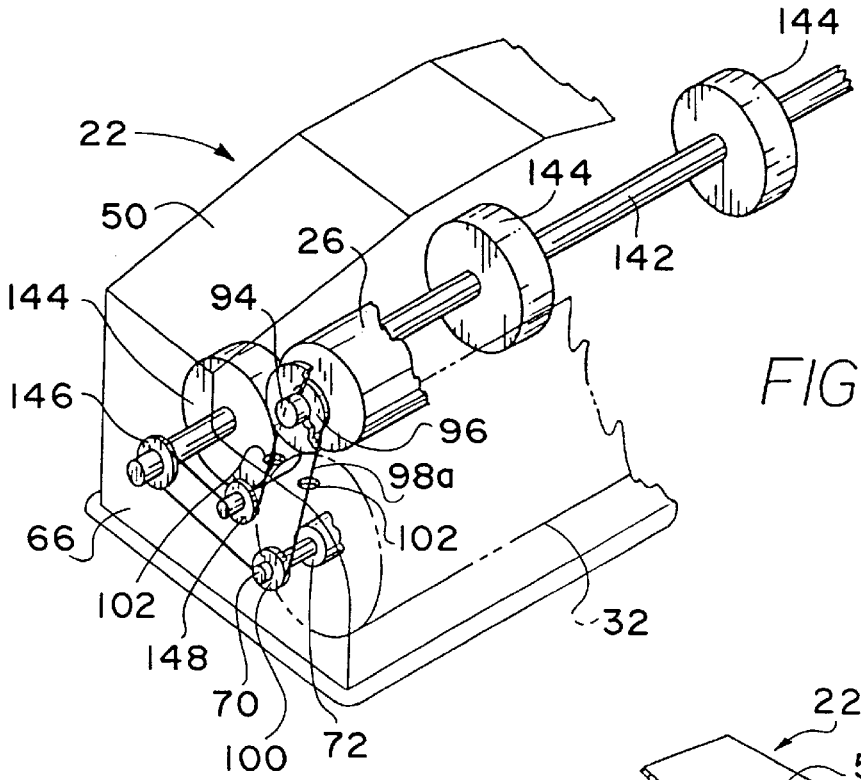
FIG. 10 is a fragmentary perspective view with the vacuum housing shown in phantom lines to reveal the drive mechanism for powering the rear wheels of the handheld version of the underwater vacuum according to the present invention.
Figure 11:
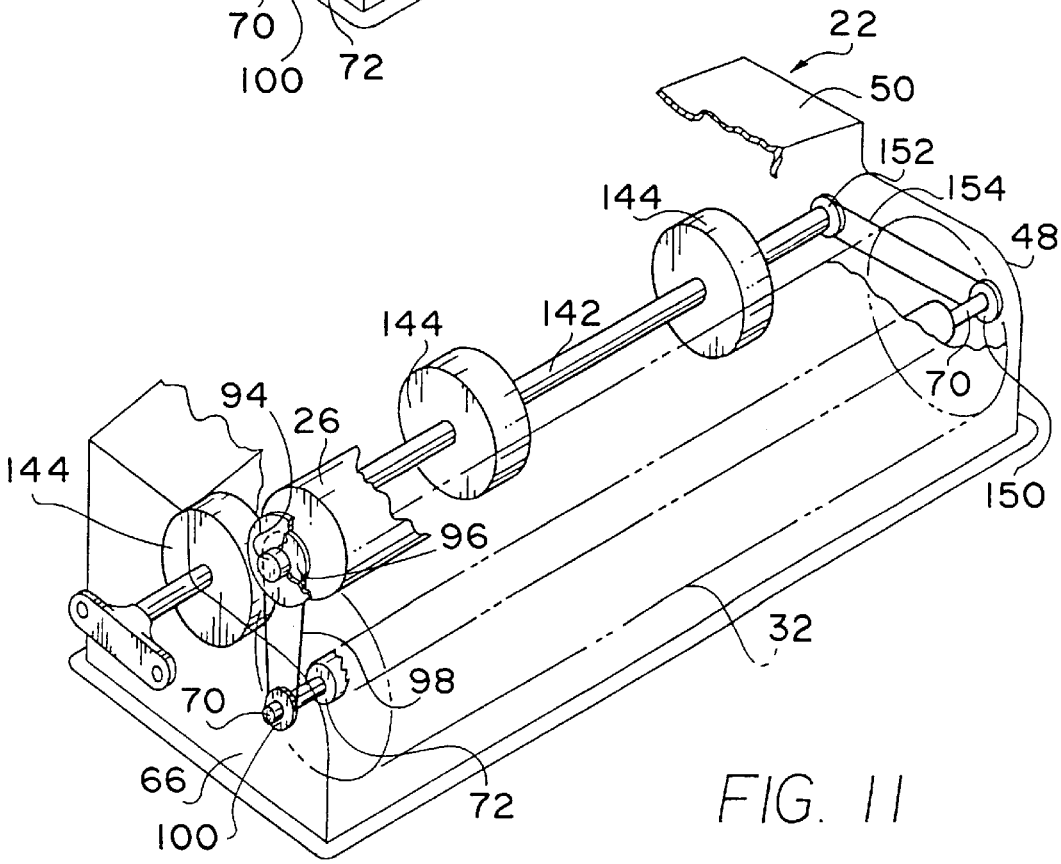
FIG. 11 is a fragmentary perspective view with the vacuum housing shown in phantom lines to reveal an alternative drive mechanism for powering the rear wheels of the handheld version of the underwater vacuum according to the present invention.

Referring to FIGS. 10 and 11, alternative, exemplary means for powering the rotation of the shaft 142 are seen. Referring to FIG. 10, a pulley 146 is fixed to the shaft 142 near the attachment of the shaft 142 to the right sidewall 66. An idler pulley 148 is rotatably supported by the right sidewall 66. A longer belt 98*a* is routed a round the pulleys 96, 100, and 146. The idler pulley 148 maintains proper tension in the belt 98*a* for proper frictional engagement of the belt 98*a* with the pulleys 96, 100, and 146. Thus, the belt 98*a* frictionally engages the pulleys 96, 100, and 146. It should be readily apparent that, by the above described arrangement, the rotation of the shaft 94 also causes the rotation of the shafts 70 and 142. The wheels 144 being fixed to the shaft 142, the turbines 28 and 30 power the rotation of the wheels 144 as the turbines cause the shaft 94 to rotate. As before, the pulleys 96, 100, 146, and 148 and the belt 98*a* can be replaced by a chain and sprockets or by a gear train.

Referring to FIG. 11, a pulley 152 is fixed to the shaft 142 near the attachment of the shaft 142 to the left sidewall 68. Another pulley 150 is fixed to the shaft 70 near the attachment of the shaft 70 to the left sidewall 68. A second belt 154 frictionally engages both pulleys 150 and 152 such that the rotation of the shaft 70 also causes the rotation of the shaft 142. The wheels 144 being fixed to the shaft 142, the turbines 28 and 30 power the rotation of the wheels 144 as the turbines cause the shaft 94, and in turn the shaft 70, to rotate. Again, chain and gear drives can be substituted for the belt drive schemes discussed above.

In use, the suction created at the suction opening keeps the housing 22 forced toward the surface of the berm. Power from the turbines 28 and 30 causes the wheels 144 to turn and thus propel the vacuum 20*a* across the surface of the berm being cleaned. The diver holds on to the grips 140 and moves along with the vacuum 20*a*, and the diver uses his/her body and feet to guide the vacuum 20*a* along the desired path over the surface of the berm.

It is to be understood that the present invention is not limited to the embodiments described above, but encompasses any and all embodiments within the scope of the following claims.

I claim:

1. An underwater vacuum comprising:

a vacuum housing having a suction opening at the bottom thereof and a vacuum housing outlet opening, and said vacuum housing having an exterior and an interior;

a turbine housing fixed to said exterior of said vacuum housing, said turbine housing having a turbine housing inlet and a turbine housing outlet, said turbine housing inlet being in fluid communication with said vacuum housing outlet opening;

a turbine rotatably supported within said turbine housing;

an outlet pipe supported by said vacuum housing, said outlet pipe having an outlet pipe inlet and an outlet pipe outlet, said outlet pipe inlet being in fluid communication with said turbine housing outlet;

a plurality of wheels rotatably supported by said vacuum housing proximate said suction opening, said plurality of wheels supporting said suction opening adjacent a surface to be cleaned, and allowing the underwater vacuum to be moved about the surface to be cleaned;

a brush rotatably supported within said vacuum housing, said brush having a plurality of bristles, said brush being positioned within said vacuum housing such that a predetermined number of said plurality of bristles project beyond said suction opening to the outside of said vacuum housing and contact the surface to be cleaned; and means for transmitting rotational motion from said turbine to said brush;

whereby, when said underwater vacuum is supported adjacent a submerged surface to be cleaned by said plurality of wheels and when said outlet pipe outlet is connected to a pump via a hose and the pump is turned on, water being drawn through said vacuum housing will cause rotation of said turbine, which in turn causes rotation of said brush, to thereby dislodge matter from the submerged surface, the dislodged matter becoming entrained in water being drawn through said vacuum housing, the water and the dislodged matter being removed from proximity of the submerged surface via the hose.

2. The underwater vacuum according to claim 1, wherein said suction opening has a rear edge, a right edge, a left edge, and a front edge, and wherein said plurality of wheels includes a plurality of rear wheels and a plurality of front wheels, said plurality of front wheels being rotatably supported on said exterior of said vacuum housing proximate said front edge, and said plurality of rear wheels being positioned intermediate said rear edge and said brush.

3. The underwater vacuum according to claim 2, further comprising means for transmitting rotational motion to said plurality of rear wheels from said turbine, whereby the underwater vacuum is self-propelled over the surface being cleaned.

4. The underwater vacuum according to claim 3, wherein the vacuum housing has a rear wall, the underwater vacuum further comprising a pair of grips fixed to said rear wall.

5. The underwater vacuum according to claim 2, wherein:

said suction opening has a perimeter and said perimeter of said suction opening defines a plane, wherein each of said plurality of front wheels is attached to said vacuum housing by a respective one of a first plurality of adjustable attachment means such that the position of each of said plurality of front wheels can be adjusted in a direction approximately perpendicular to said plane of said suction opening; and wherein said plurality of rear wheels are coaxially fixed to a common shaft rotatably supported by said vacuum housing, there further being a second pair of adjustable attachment means, each end of said common shaft being attached to said vacuum housing by a respective one of said second pair of adjustable attachment means, such that the position of all of said plurality of rear wheels can be adjusted in a direction approximately perpendicular to said plane of said suction opening simultaneously.

6. The underwater vacuum according to claim 1, further comprising a debris trap provided intermediate said vacuum housing outlet and said turbine housing inlet, fluid communication between said vacuum housing outlet and said turbine housing inlet provided via said debris trap.

7. The underwater vacuum according to claim 1, wherein said turbine is a first turbine, the underwater vacuum further comprising:

a second turbine; and a common turbine shaft rotatably supported within said turbine housing, said first turbine and said second turbine being fixed in tandem to said common turbine shaft, whereby water rushing through said first turbine and said second turbine causes rotation of said common turbine shaft.

8. The underwater vacuum according to claim 7, further comprising a plurality of re-directional baffles provided intermediate said first turbine and said second turbine, said plurality of re-directional baffles straightening water flow from said first turbine before the water flow from said first turbine impinges upon said second turbine.

9. The underwater vacuum according to claim 1, wherein the vacuum housing has a rear wall, the underwater vacuum further comprising:

a socket attached to said rear wall; and a T-shaped handle having a gripping portion and a distal end distal from said gripping portion, said distal end of said T-shaped handle being inserted into said socket.

10. The underwater vacuum according to claim 1, wherein said suction opening has a perimeter and said perimeter of said suction opening defines a plane, and wherein each of said plurality of wheels is attached to said vacuum housing by adjustable attachment means such that the position of each of said plurality of wheels can be adjusted in a direction approximately perpendicular to said plane of said suction opening.

11. The underwater vacuum according to claim 1, there further being adjustable attachment means, said suction opening having a perimeter and said perimeter of said suction opening defining a plane, said brush being attached to said vacuum housing by said adjustable attachment means, such that the position of said brush can be adjusted in a direction approximately perpendicular to said plane of said suction opening.

12. An underwater vacuum comprising:

a vacuum housing having a suction opening at the bottom thereof and a vacuum housing outlet opening, said suction opening being substantially rectangular and having a rear edge, a right edge, a left edge, and a front edge, said suction opening having a perimeter and said perimeter of said suction opening defining a plane, said vacuum housing having an exterior and an interior, said vacuum housing having a base portion and a cap portion, said cap portion having a rear wall and a front wall spaced apart from said rear wall, said cap portion having a closed top and an open bottom, said open bottom being smaller in area than said suction opening, said cap portion being joined to said base portion at said open bottom of said cap portion, said cap portion having lateral walls that extend between said front and rear wall, said cap portion having a decreasing cross sectional area in sections parallel to said plane of said suction opening, said cross sectional area of said cap portion decreasing from a maximum where said cap portion joins said base portion to a minimum at said closed top of said cap portion;

said base portion having a curved front wall extending from said front edge of said suction opening to said front wall of said cap portion, a rear wall extending perpendicular to said plane of said suction opening from said suction opening rear edge to said rear wall of said cap portion, a right sidewall extending from said curved front wall of said base portion to said rear wall of said base portion and from said right edge of said suction opening to said cap portion, and a left sidewall extending from said curved front wall of said base portion to said rear wall of said base portion and from said left edge of said suction opening to said cap portion, said front and rear walls of said base portion, said left sidewall, said right sidewall, and said cap portion cooperatively forming a concavity which opens to said suction opening;

said vacuum housing outlet opening being formed in said front wall of said cap portion, said vacuum housing outlet opening being as wide as said closed top of said cap portion and extending from said closed top of said cap portion to said curved front wall of said base portion;

a turbine housing fixed to said exterior of said vacuum housing said turbine housing having a turbine housing inlet and a turbine housing outlet, said turbine housing inlet being in fluid communication with said vacuum housing outlet opening;

a turbine rotatably supported within said turbine housing;

an outlet pipe supported by said vacuum housing, said outlet pipe having an outlet pipe inlet and an outlet pipe outlet, said outlet pipe inlet being in fluid communication with said turbine housing outlet;

a brush rotatably supported within said vacuum housing, said brush having a plurality of bristles, said brush being positioned within said vacuum housing such that a predetermined number of said plurality of bristles project beyond said suction opening to the outside of said vacuum housing and contact the surface to be cleaned;

a plurality of front wheels rotatably supported on said exterior of said vacuum housing proximate said front edge of said suction opening;

a plurality of rear wheels rotatably supported by said interior of said vacuum housing intermediate said rear edge of said suction opening and said brush, said front and rear plurality of wheels supporting said suction opening adjacent a surface to be cleaned and allowing the underwater vacuum to be moved about the surface to be cleaned; and means for transmitting rotational motion from said turbine to said brush;

whereby, when said underwater vacuum is supported adjacent a submerged surface to be cleaned by said plurality of wheels and when said outlet pipe outlet is connected to a pump via a hose and the pump is turned on, water being drawn through said vacuum housing will cause rotation of said turbine which in turn causes rotation of said brush to thereby dislodge matter from the submerged surface, the dislodged matter becoming entrained in water being drawn through said vacuum housing, the water and the dislodged matter being removed from proximity of the submerged surface via the hose.

13. The underwater vacuum according to claim 12, further comprising a debris trap provided intermediate said vacuum housing outlet and said turbine housing inlet, fluid communication between said vacuum housing outlet and said turbine housing inlet provided via said debris trap.

14. The underwater vacuum according to claim 12, wherein said turbine is a first turbine, the underwater vacuum further comprising:

a second turbine; and a common turbine shaft rotatably supported within said turbine housing, said first turbine and said second turbine being fixed in tandem to said common turbine shaft, whereby water rushing through said first turbine and said second turbine causes rotation of said common turbine shaft.

15. The underwater vacuum according to claim 14, further comprising a plurality of re-directional baffles provided intermediate said first turbine and said second turbine, said plurality of re-directional baffles straightening water flow from said first turbine before the water flow from said first turbine impinges upon said second turbine.

16. The underwater vacuum according to claim 12, wherein said vacuum housing has a rear wall formed by said rear wall of said base portion and said rear wall of said cap portion, the underwater vacuum further comprising:

a socket attached to said rear wall of said vacuum housing; and a T-shaped handle having a gripping portion and a distal end distal from said gripping portion, said distal end of said T-shaped handle being inserted into said socket.

17. The underwater vacuum according to claim 12, further comprising means for transmitting rotational motion to said plurality of rear wheels from said turbine, whereby the underwater vacuum is self-propelled over the surface being cleaned.

18. The underwater vacuum according to claim 17, wherein said vacuum housing has a rear wall formed by said rear wall of said base portion and said rear wall of said cap portion, the underwater vacuum further comprising a pair of grips fixed to said rear wall of said vacuum housing.

19. The underwater vacuum according to claim 12, there further being adjustable attachment means, each of said plurality of front and rear wheels being attached to said vacuum housing by said adjustable attachment means, such that the position of each of said plurality of front and rear wheels can be adjusted in a direction approximately perpendicular to said plane of said suction opening.

20. The underwater vacuum according to claim 12, wherein:

each of said plurality of front wheels is attached to said vacuum housing by a respective one of a first plurality of adjustable attachment means, such that the position of each of said plurality of front wheels can be adjusted in a direction approximately perpendicular to said plane of said suction opening; and wherein said plurality of rear wheels are coaxially fixed to a common shaft rotatably supported by said vacuum housing, there further being a second pair of adjustable attachment means, each end of said common shaft being attached to said vacuum housing by a respective one of said second pair of adjustable attachment means, such that the position of all of said plurality of rear wheels can be adjusted in a direction approximately perpendicular to said plane of said suction opening simultaneously.

* * * * *